US007288306B2

(12) United States Patent
Kersey

(10) Patent No.: US 7,288,306 B2
(45) Date of Patent: Oct. 30, 2007

(54) TEXTILE SUBSTRATE HAVING LOW VARIABLE TWIST YARN

(75) Inventor: Brandon Kersey, Rocky Face, GA (US)

(73) Assignee: Mannington Mills, Inc., Salem, NJ (US)

( * ) Notice: Subject to any disclaimer, the term of this patent is extended or adjusted under 35 U.S.C. 154(b) by 141 days.

(21) Appl. No.: 10/925,607

(22) Filed: Aug. 25, 2004

(65) Prior Publication Data

US 2006/0046020 A1 Mar. 2, 2006

(51) Int. Cl.

| | |
|---|---|
| ***B32B 3/02*** | (2006.01) |
| ***B32B 33/00*** | (2006.01) |
| ***D02G 3/22*** | (2006.01) |
| ***D02G 3/44*** | (2006.01) |

(52) U.S. Cl. ..... 428/92; 57/236; 57/238; 57/362; 428/88; 428/89

(58) Field of Classification Search ..... 428/92, 428/88, 89, 97; 57/236, 238, 362
See application file for complete search history.

(56) References Cited

U.S. PATENT DOCUMENTS

| | | | | |
|---|---|---|---|---|
| 3,981,130 | A | 9/1976 | Aimbinder et al. | 57/58.3 |
| 4,034,544 | A | 7/1977 | Clarkson | 57/34 |
| 4,266,397 | A | 5/1981 | Dönmez et al. | 57/261 |
| 4,276,740 | A | 7/1981 | Chambley et al. | 57/205 |
| 4,329,841 | A | 5/1982 | Mang | 57/288 |
| 4,375,744 | A | 3/1983 | Briner et al. | 57/96 |
| 4,606,181 | A | 8/1986 | Lappage et al. | 57/58.38 |
| 4,736,579 | A | 4/1988 | Stenmans | 57/58.52 |
| 4,922,703 | A | 5/1990 | Matsui et al. | 57/93 |
| 5,060,467 | A | 10/1991 | Gill et al. | 57/13 |
| 5,150,566 | A | 9/1992 | Stenmans | 57/58.83 |
| 5,174,102 | A | 12/1992 | Matsui et al. | 57/264 |
| 5,237,805 | A | 8/1993 | Menegatto | 57/16 |
| 5,706,642 | A | 1/1998 | Haselwander | 57/264 |

*Primary Examiner*—Cheryl Juska
(74) *Attorney, Agent, or Firm*—Kilyk & Bowersox, P.L.L.C.

(57) ABSTRACT

A textile substrate is made from two or more strands of yarn that are twisted together using a very low variable twist level. The amount of slight twist and variation in the twist are effective to give the finished carpet made from the textile substrate a uniform appearance in spite of any slight variations in one or more characteristics of the yarn. The textile substrate, by using such a low variable twist level, can avoid streaks in the carpet, for instance, caused by variations in yarn lots and the like.

17 Claims, 6 Drawing Sheets

TEXTILE SUBSTRATE HAVING LOW VARIABLE TWIST YARN

BACKGROUND OF THE INVENTION

The present invention relates to textile substrates having yarn or threads provided with variable twist in accordance with a desired pattern, and methods and apparatus for making such textile substrates.

U.S. Pat. No. 5,706,642 to Haselwander relates to a process and system for forming a twisted yarn having multiple plies of yarn which eliminates the need for changing gears, cams, or other mechanical or manual devices and which permits large twist pattern variations in the product such that the length of the segments of a desired twist level may be varied along with the twist level. This yarn can be utilized for forming carpet or other textiles with unique and different patterns and aesthetics. The '642 patent accomplishes this system for forming a twisted yarn by using a motor controlled by a programmable controller which drives the respective motor at precise speeds for precise times to change the speed ratios in accordance with the pattern desired. As discussed in the '642 patent, the pattern achieved by this variable twist level is generally a pattern having a high variation of twist levels, ranging from 1.5 turns of twist per inch to 6.5 turns of twist per inch and the like. Thus, the carpet made by this process generally has twist levels in this entire range. When a textile substrate is formed using this high level of variable twists, as indicated in the '642 patent, different patterns can be achieved on the surface of the textile substrate. Thus, the purpose of the '642 patent is to cause variations in the twist levels such that different patterns are created and such that the variable twist levels can be easily programmed and varied.

As discussed in detail below, unlike the '642 patent, the present invention relates to using a very low variable twist level such that the overall pattern on the textile substrate is visually the same. By using a low variable twist level, as discussed in detail below, variations in the color from yarn lot to yarn lot, as well as other characteristics that may vary from manufacture runs, can be minimized, if not avoided, by using a low variable twist level such that these variations are not visually apparent to a person. Thus, the present invention uses a variable twist in essentially the opposite manner intended in the '642 patent.

In forming textile substrates, yarn is used wherein the yarn during manufacture runs is supplied from various yarn lots or spindles. The yarn generally is colored yarn and many times is colored by a dyeing process. The color of the yarn from lot to lot or spindle to spindle can, unfortunately, vary in color or other characteristics such that when a textile substrate is formed (in other words, the yarn is tufted into the primary backing), variations in the color of the yarn from spindle to spindle can be seen occasionally, and when this occurs, there is a clear demarcation between the spindle changes such that streaking occurs in the carpet substrate. Needless to say, when this occurs, a portion of the product is unusable and must be rejected and considered waste. This occurrence can lead to undesirable waste and costs to the carpet manufacturer. While efforts have been made to ensure that yarn lots are consistent, it is an imprecise science, and any slight color variation from spindle to spindle can, unfortunately, be seen by the observer using the carpet. When twisted yarn is used to make a carpet, this problem can be even more readily apparent. Accordingly, there is a desire in the industry to avoid streaking and to provide some type of process which can compensate for this color variation from yarn lot to yarn lot and other variations that may occur in the yarn from lot to lot.

In the art of twisting yarn and thread, hereinafter together referred to as yarn twisting, a pre-determined twist level and twist direction is selected and remains constant for a particular finished yarn. Twist level is defined as the turns of twist or wrap of the yarn or thread about each other for a given segment of length of the twisted yarn or thread. The twisting of yarn involves twisting at least one strand or ply of yarn together or about another such that there is a pre-determined number of turns of yarn twisted with or wrapped about another yarn. Various twisting techniques are utilized in the art to obtain a twisted multiple ply yarn product. For example, ring twisting wherein strands of yarn pass through a ring and are twisted as the ring rotates about a rotating bobbin on which the yarn is wound; two-for-one twisting wherein two bobbins of yarn are combined within a common can, and the yarns are passed through the center of a rotating yarn twister spindle and out a radial hole; and cabling wherein one or more yarn strands enter the bottom of a rotating twister spindle at the center and exit through a radial hole and enter an eyelet or ring to form a balloon which throws out about a supply bobbin of another yarn with which it is twisted; are three such methods for twisting yarn strands together or one or more yarns twisted about another yarn. In each method it is the general practice to maintain the twist level or number of turns per inch of the yarn constant. Machines that perform these methods include a common drive motor, and the ratio between the yarn speed and the final yarn package speed, which determines the twist level, is obtained by the use of change twist gears. Thus, the twist level of a particular yarn is constant and is monitored to remain constant. In order to change twist level, different change twist gears are utilized, but this can only be done for one twisted yarn at a time, i.e., a single yarn has only one twist level.

It has been found that if the twist level of a given yarn may be varied along its length, products made from such yarn, such as carpet, may have unusual aesthetic styling. In the prior art, an attempt to obtain twist variation along the length of the yarn was proposed in Lloyd (U.S. Pat. No. 2,933,881), which utilizes a variable speed device wherein the output speed is controlled by a control lever either moved by a cam or manually moved to change the speed of the yarn take-up spool to vary the twist of the yarn within the final package. It clearly is impracticable to vary the twist manually with such an apparatus since reproducible results would not be obtainable. If a cam is used to create the twist level variation, the variation is limited by the shape and size of the cam, and if another pattern of twisting levels is desired, the cam must be changed.

Yamada et al. (U.S. Pat. No. 4,569,192) involves single strand spun yarns wherein the fibers are spun, drafted and twisted. It was proposed to vary the twist and drafting of the strand while the spun yarn strand is being formed in yarn spinning equipment.

Furthermore, there is no known textile substrate, whether incorporated into carpet tiles or into rolls of carpet, wherein the amount of, and/or variation in, twist level of the yarns is provided to achieve a desired uniform appearance of the carpet in spite of possible variations in characteristics of the yarn provided from different supply spindles or caused by other reasons.

SUMMARY OF THE PRESENT INVENTION

Consequently, it is desirable according to various embodiments to provide a textile substrate having at least a portion with variable twisted yarn, with the variable twisted yarn including two or more strands of yarn with small amounts of twist effective to render a uniform appearance to the finished carpet in spite of possible variations in color or other characteristics of yarn obtained from different supply spindles.

In one or more embodiments, the textile substrate can include two or more yarn strands with twist in the range from about 0.25 turn per inch of the yarn to about 3 turns per inch of the yarn. According to various embodiments, the textile substrate can include two or more yarn strands with twist in the range from about 0.25 turn per inch of the yarn to about 1.5 turns per inch of the yarn. The yarn used in making the textile substrate can be obtained from different supply spindles with possible variations in characteristics such as color, with the finished carpet or carpet tile made from the yarn having a desired uniform appearance as a result of the variation of twist level or number of twists per length of the yarn.

According to various embodiments, a textile substrate has at least a portion with two or more strands of yarn wherein the strands of yarn are supplied from different supply spindles and have variations in one or more characteristics, such as color. The strands of yarn can be provided with a small twist level, such as from approximately 0.25 twist per inch to 1.5 twists per inch, with the twist level and/or variation in twist level of the yarns being effective to provide the finished carpet made from the textile substrate with a uniform appearance even when there are variations in some characteristics of the yarn, such as slightly different colors, for the yarns drawn from different supply spindles.

According to various embodiments, a textile substrate having two or more strands of yarn that are provided with a small twist level such as from approximately 0.25 twist per inch to 1.5 twists per inch, can be a carpet tile, a roll of carpet, or other form of carpet, wherein the twist level and/or variation in twist level is sufficient to give the carpet a uniform appearance even when there are variations in some characteristics of the yarn, such as slightly different colors for yarns, for instance, drawn from different supply spindles.

According to various embodiments, a method and apparatus is provided for twisting two or more strands of yarn into a twisted yarn while varying the twist level and/or twist direction selectively along selected lengths of the yarn. The amount of twist applied to the strands of yarn according to various embodiments can be from approximately 0.25 turn per inch of the yarn to approximately 1.5 turns per inch of the yarn.

It is also desirable according to various embodiments to provide a method and apparatus for twisting two or more yarn strands together in accordance with a selective twist pattern and for changing the pattern selectively.

According to various embodiments, a method for twisting at least two yarn strands together into a twisted yarn product includes providing a supply of the yarn strands, providing at least one fluid jet device having a controllable fluid blast, providing a rotatable feed roll, and storing in a programmable controller data for control of the at least one fluid jet device and the rotatable feed roll in a manner suitable to generate a pattern made up of variations in at least one of the twist level and the direction of twist of a finished twisted yarn product along the length of the yarn. The method includes controlling the fluid blast from the at least one fluid jet device to effect a desired yarn twist on the yarn strands, such as by controlling the pressure of the fluid provided to the fluid jet device, controlling rotation of the feed roll to feed the yarn strands at a predetermined speed of travel between the supply of yarn strands, the at least one fluid jet device and a package of the finished twisted yarn product, and controlling the fluid blast and the rotation of the feed roll according to the data stored in the programmable controller to provide at least one of a first twist level and a first twist direction of the yarn for a first length of the finished twisted yarn product, and at least one of a second twist level and a second twist direction of the yarn for a second length of the finished twisted yarn product.

According to various embodiments, a system for twisting at least two yarn strands together into a finished twisted yarn having a twist level and/or a twist direction that is varied along its length in accordance with a pattern includes a supply of yarn strands, at least one fluid jet device adapted to impose a twisting torque on individual yarn strands, a rotatable feed roll adapted to feed the yarn strands at a predetermined speed of travel between the supply of yarn strands, the at least one fluid jet device and a package of the finished twisted yarn product, and a control device that selectively rotates the rotatable feed roll and operates the at least one fluid jet device at selected speeds for a selected first time period to provide at least one of a first twist level and a first twist direction of the yarn strands for a first length of the finished twisted yarn product, and that selectively rotates the rotatable feed roll and operates the at least one fluid jet device at selected speeds for a selected second time period to provide at least one of a second twist level and a second twist direction of the yarn strands for a second length of the finished twisted yarn product.

In accordance with various embodiments, various patterns may be stored in a processing device or controller which controls the final pattern of the yarn and can be programmed to make various patterns. Changing from one pattern to another merely involves accessing the pattern from stored information in the processing device.

DETAILED DESCRIPTION OF THE PRESENT INVENTION

Figure 1:
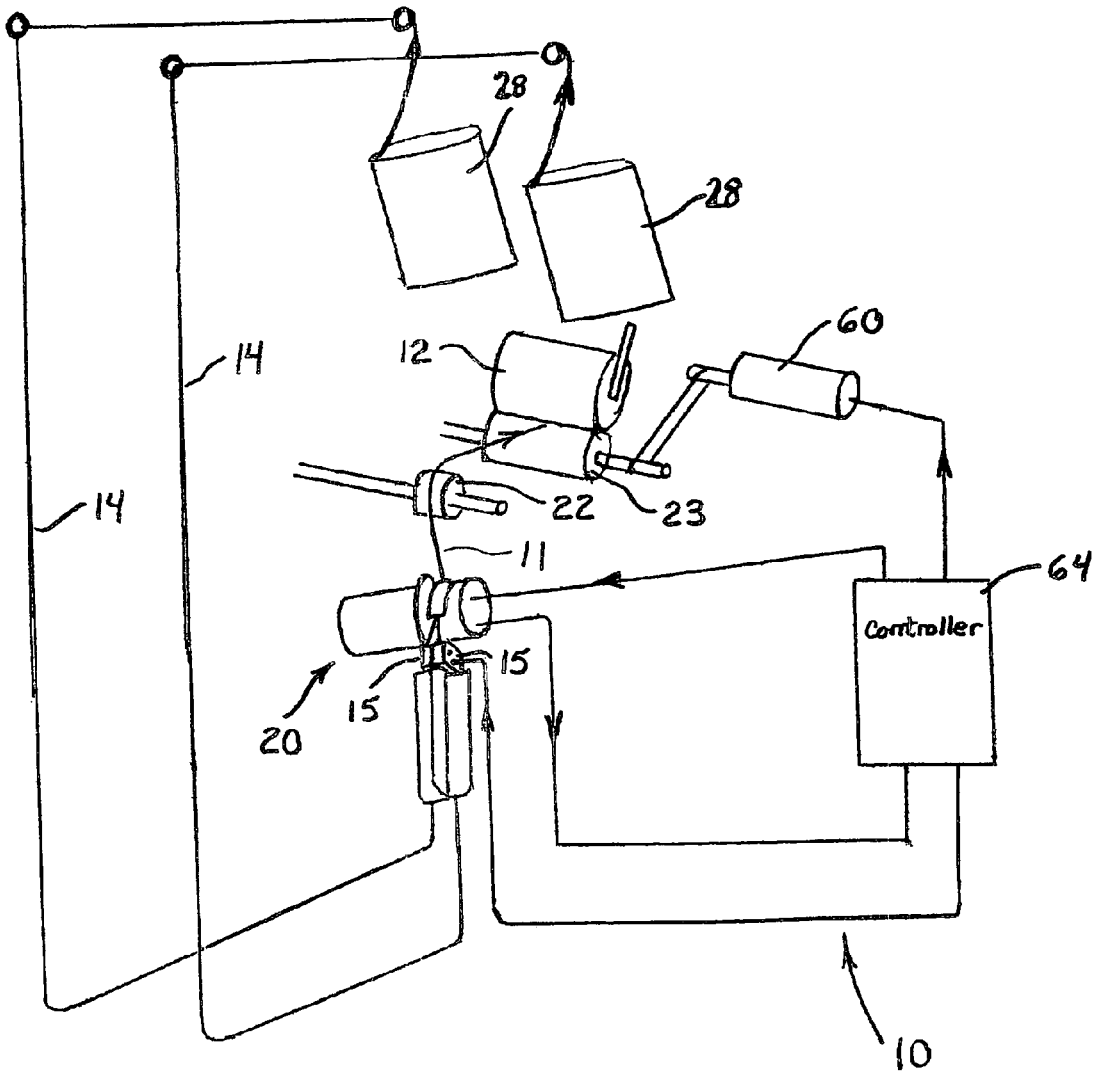
FIG. 1 is a diagrammatic view illustrating an apparatus for the twisting of two yarn strands together using an fluid twisting device into a twisted yarn product and having patterning apparatus constructed in accordance with an embodiment of the present invention.

The present invention provides a solution to variations in color, for instance, caused from yarn lot to yarn lot or from the color changing slightly in the same yarn lot. The present invention further provides a solution to problems identified as streaking in the carpet caused by color variations in yarn lots to yarn lots or streaking caused by other reasons. The present invention uses a very low variable twist level such that these variations are more difficult, if not impossible, to see by an observer walking on the carpet. By having a slight variation in the twist level, these variations are in essence blended together and create some room for error with respect to color variation. If the same exact twist level was used, these errors would be readily apparent to the observer walking on the carpet. However, by using a slight variation in the twist level, these color variations which cause streaking can be significantly minimized, if not totally avoided, in the sense that they would not be seen by the user of the carpet. In general, the present invention relates to methods to form variable twisted yarn, including providing two or more yarns for application in a textile substrate, the yarns being provided with only a slight twist and/or variation in twist, such as, for example, from approximately 0.25 twist per inch of twisted yarn to approximately 3 twists per inch, and more preferably, about 0.25 twist per inch to about 1.5 twists per inch of twisted yarn, and textile substrates made with at least a portion of the substrates having the twisted yarns. Generally, the low variable twist level will not exceed about 3 twists per inch of twisted yarn since any amounts above this would cause a change in the pattern of the textile substrate. The goal of the present invention is to have a low variable twist level such that it is not noticeable to the observer, and thus avoids the formation of any pattern different from the overall pattern which is preferably a uniform pattern. Thus, the present invention provides a method to avoid streaking in a carpet by using a very low variable twist level in forming the twisted yarn used to form the textile substrate. The present invention further provides a method to promote the uniform and consistent appearance of textile substrates formed by using a low variable twist level in twisted yarn. In the present invention, the variation is so low that while a variable twist level is used and that there is technically a variation in the carpet, this variation is so low that the carpet is visually uniform in appearance to the observer. The slight twist to the yarn can be applied to result in a finished carpet made from the textile substrates having the twisted yarn, wherein the finished carpet has a uniform appearance in spite of variations in the yarn, such as color variations, that may result from changes in the supply spindles of yarn. The carpet can be rolled carpet or carpet tiles of any size. The carpet can be piled or looped. For instance, the slightly twisted yarn can be tufted into a primary backing and then a pre-coat layer can be applied to lock the tufts in. Any number of intermediate layers and a secondary backing can be used. The methods involve forming twisted yarn by fluid twisting or other known twisting methods including, but not limited to, the cabling method, the two for one twisting method, or ring twisting methods, as described in detail in U.S. Pat. No. 5,706,642, which is incorporated in its entirety by reference herein.

For purposes of the present invention, the use of air to cause twisting is discussed, but any fluid capable of causing the twisting of the yarn can be used and is considered part of the present invention, including any gas and/or liquid, such as water, steam, carbon dioxide, inert gases, and the like. Further, the present invention in one or more embodiments involves means to vary the amount of twist in twisted yarn by varying the pressure and/or volume of the fluid (e.g., air) that contacts the yarn to cause the twisting of the yarn, or varying the speed of a motor which may have its speed controlled for driving at least the product package or the yarn twisting means, or both, and/or involves varying the speed of the yarn passing through the device that causes the twisting of the yarn. Generally, at least two strands of yarn form the final twisted yarn, each strand of yarn that is false twisted can be twisted to the same or different level. When more than one fluid feed is used to cause the twisting of the two or more yarns (for instance, one fluid stream per yarn to be false twisted), each fluid feed can be varied similarly or differently at the same or different pre-determined time intervals. Thus, at one point, the pressure can be 100 psi and then at a pre-determined time, can be varied to a different psi and so on to achieve a variation in the amount or level of twist in the yarn. For instance, the psi of the fluid can be from 2 psi to 200 psi or more. As described in detail below, when the yarns that have been twisted (false twisted) are brought together to essentially unwind upon each other to form the twisted yarn, the amount of twist previously present in the false twisted individual yarns leads to the twisting together of the various yarns and the formation of a length of yarn that has variation in the twist level due to the variations of the false twisted yarn. The variation in twist level can be any amount of variation for any length of twisted yarn. In one or more embodiments the twist level for two or more yarns can be from approximately 0.25 twist per inch to approximately 1.5 twist per inch, wherein the slight twist and/or variation in twist can result in a finished carpet having a uniform appearance even when two or more yarns differ in one or more characteristics such as color as a result of having been drawn from different supply spindles. According to various embodiments, the twist level for two or more yarns can be from approximately 0.25 twist per inch to approximately 3.0 twists per inch, wherein the slight twist and/or variation in twist can result in a finished carpet having a uniform appearance even when two or more yarns differ in one or more characteristics such as color, which may occur as a result of having been drawn from different supply spindles.

Figure 4:
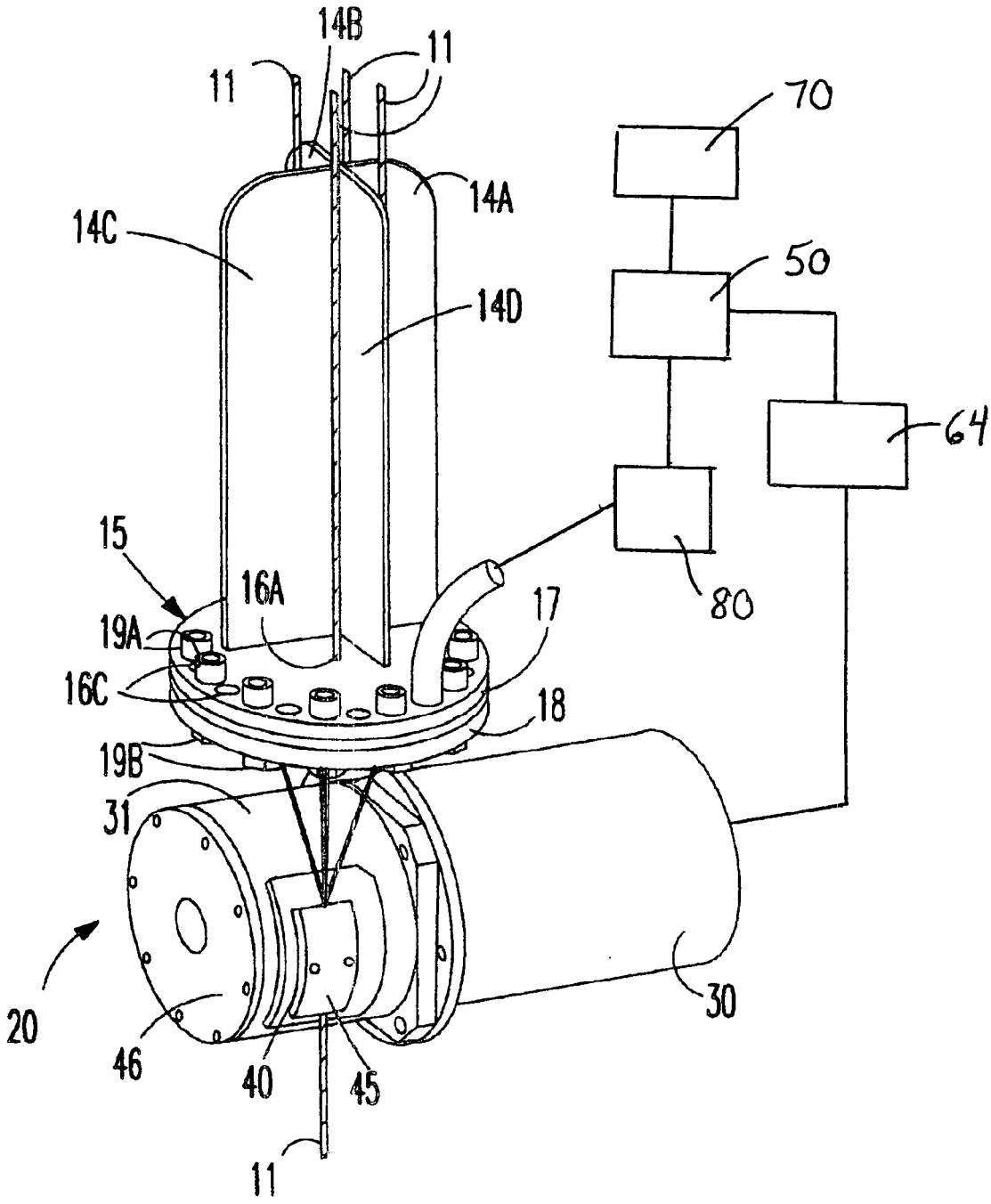
FIG. 4 is a view of another embodiment of a rotary fluid-jet assembly.

Referring now to the drawings, FIG. 1 illustrates a multiple yarn package cabling type twisting system 10 for twisting two yarns into a product package 12 of twisted yarn. Although only one station of a package 12 is illustrated, it should be understood that a yarn twisting facility may have many such stations being formed simultaneously, one hundred such stations not being uncommon. Additionally, although FIG. 1 illustrates the twisting of two yarn strands 14 which is the usual situation, three or more such yarns may be twisted together at one station by a single twister, such as shown in the embodiment of FIG. 4. Each of the strands 14 is drawn from a supply package 28 conventionally mounted overhead on a creel (not illustrated) and is fed to twist-inserting apparatus such as air jets 15, shown in FIG. 1, and a rotary air-jet assembly 20.

The combination of the twist-inserting air jets 15 and rotary air-jet assembly 20 combines the individual strands of yarn into a plied yarn 11, which is then guided around package take-up rolls 22, 23 before delivering the plied yarn to a take-up package 12. While a package roll is discussed, it is understood that any collection device can be used or the twisted yarn can be processed in a production line to make textile substrates.

The number of turns or twists of the yarn per minute, the direction of twist, and the distance between segments of plied yarn having twist in a desired direction can be derived from the pressure, amount, and direction of air flow provided through twist inserting apparatus 15 and control of an air blast provided by rotary air-jet assembly 20 as the plied yarn 11 is fed through the rotary air-jet assembly 20 on the way to package take-up rolls 22, 23. The turn per inch of yarn or twist level in the yarn package can be derived from the differential or ratio between the rate at which a twist is applied to each of the yarn threads by the air jets in twist inserting apparatus 15 and/or any additional twist imposed by the air jet within rotary air jet assembly 20, and the speed of the package take-up rolls 22, 23. Control of the rate of movement of an air jet within the rotary air jet assembly 20 can also be used to create zones of intermingled yarns at spaced-apart points along the length of the yarn strands to prevent torsional movement of one yarn relative to the other yarn. The length of the zones of intermingled yarns can be controlled by controlling the rate of speed at which the air jet within rotary air jet assembly 20 is moved relative to the rate of travel of the yarns through the air jet assembly.

Conventionally, the ratio of the speed at which twist is applied to the individual yarns and the speed at which the finished yarn is taken up on the final package is fixed and often determined by the use of gearing.

According to various embodiments, and as shown in an exemplary embodiment in FIG. 1, a motor 60 can be utilized to drive one or more of the package take-up rolls 22, 23. The motor 60 can be connected to a programmable controller 64 for controlling the speed of the motor 60. The programmable controller 64 can also provide signals to control apparatus such as fluidic valves, pressure transducers, electrical solenoid valves or mechanically operated valves, (not shown) that in turn control the pressure and/or flow of air to the twist inserting apparatus 15 as well as to the rotary air jet assembly 20. The air jets within twist inserting apparatus 15 can be controlled by the controller 64 to change the number of twists per a predetermined length of yarn, as well as being operated to control the direction of twist in the yarn and periodic reversals in the direction of twist in the yarns. As described in more detail in U.S. Pat. No. 6,089,009, which is incorporated herein in its entirety by reference, the twist inserting apparatus 15 can include a bore through which the yarn passes, and air ducts that communicate with the bore for communicating air flow. The axes of the air ducts can be laterally offset with respect to the axis of the bore through which the yarn passes, so that the air impinges tangentially on the yarn to produce either a clockwise or counterclockwise twist in the yarn. The velocity and flow rate of the air provided to the twist inserting apparatus can be varied to control the number of twist per a predetermined length of yarn.

Methods for producing "false-twist" and "self-twist" yarns are known in the art, such as described in U.S. Pat. No. 4,276,740, which is incorporated herein in its entirety by reference. The term "false-twist" refers to a yarn in which a yarn strand is twisted by a twist insertion device to generate opposite twists on either side of the device. The point in the strand where the twist reverses has zero twist and is referred to as a node. The directions of twist are referred to as "S-twist" or "Z-twist." The term "self-twist" is applied to yarns wherein two or more false twisted strands are brought together and permitted to ply themselves. The approximately equal torsional force of the same direction is stored in two or more single yarns which are later brought into contact. The torque is released, permitting the single yarns to untwist, and in so doing, wrap around each other to form a plied yarn.

Figure 2:
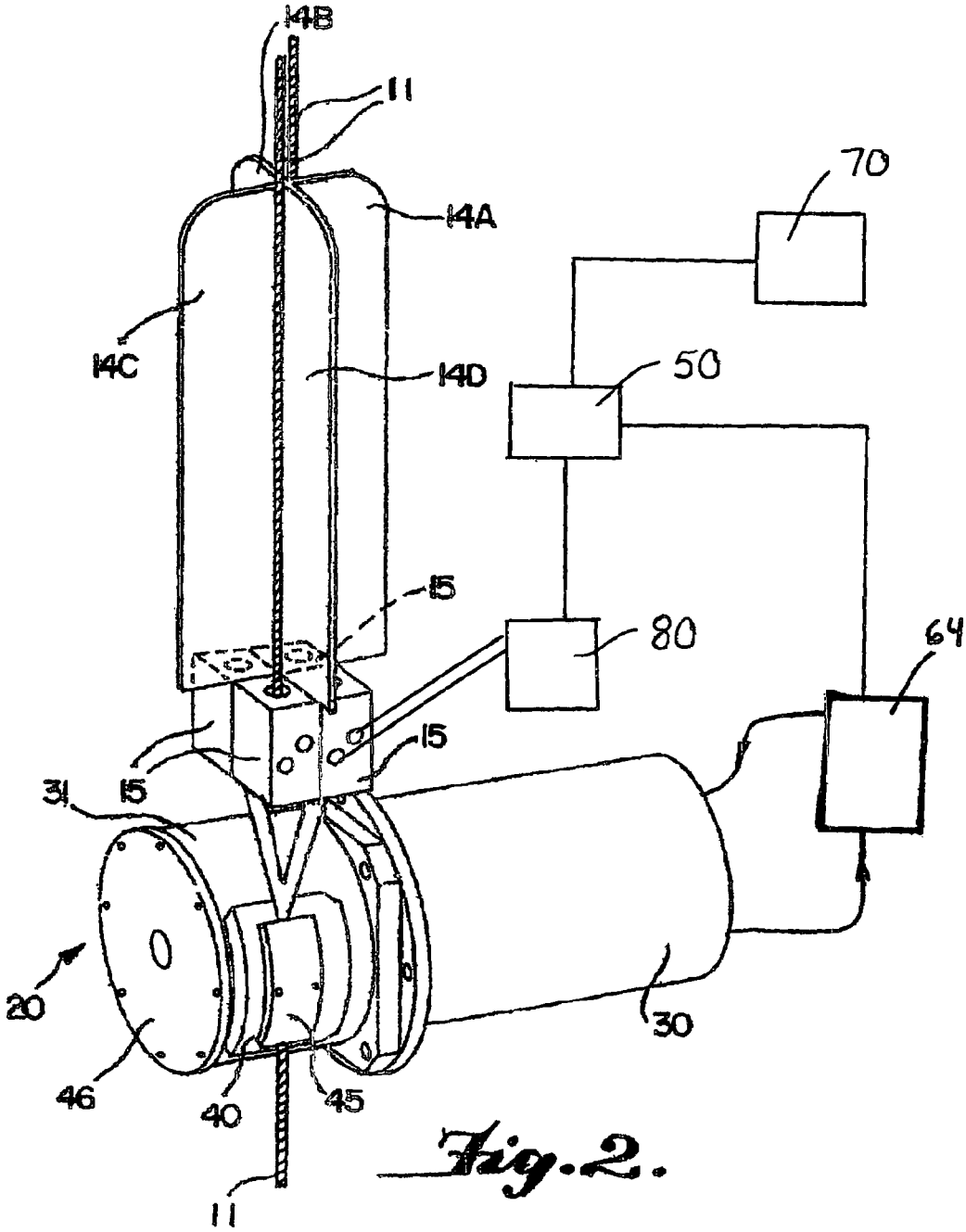
FIG. 2 is a view of the rotary fluid-jet assembly shown in FIG. 1.

Referring to FIG. 2, and according to various embodiments, the rotary air jet assembly 20 can include yarn separators 14A, 14B, 14C and 14D, that serve to keep the individual yarns 11 from touching and twisting together before passage into the twist inserting apparatus 15. The yarn 11 above the air twist apparatus 15 can be twisted in one direction, and the yarn between the twist inserting apparatus 15 and the rotary air jet assembly 20 can be twisted in the opposite direction, with the number of twists per length of yarn being controlled by the amount of the air that is supplied to the twist inserting apparatus 15, as controlled by the programmable controller 64.

As shown schematically in FIG. 2, and according to various embodiments, the programmable controller 64 can provide control signals to a pressure transducer 50, with the pressure transducer controlling the pressure of air or another fluid supplied from a source of air or another fluid 70 to one or more solenoid valves 80. The air or other fluid at a desired pressure and flow rate is then supplied to the twist inserting apparatus 15.

Figure 5:
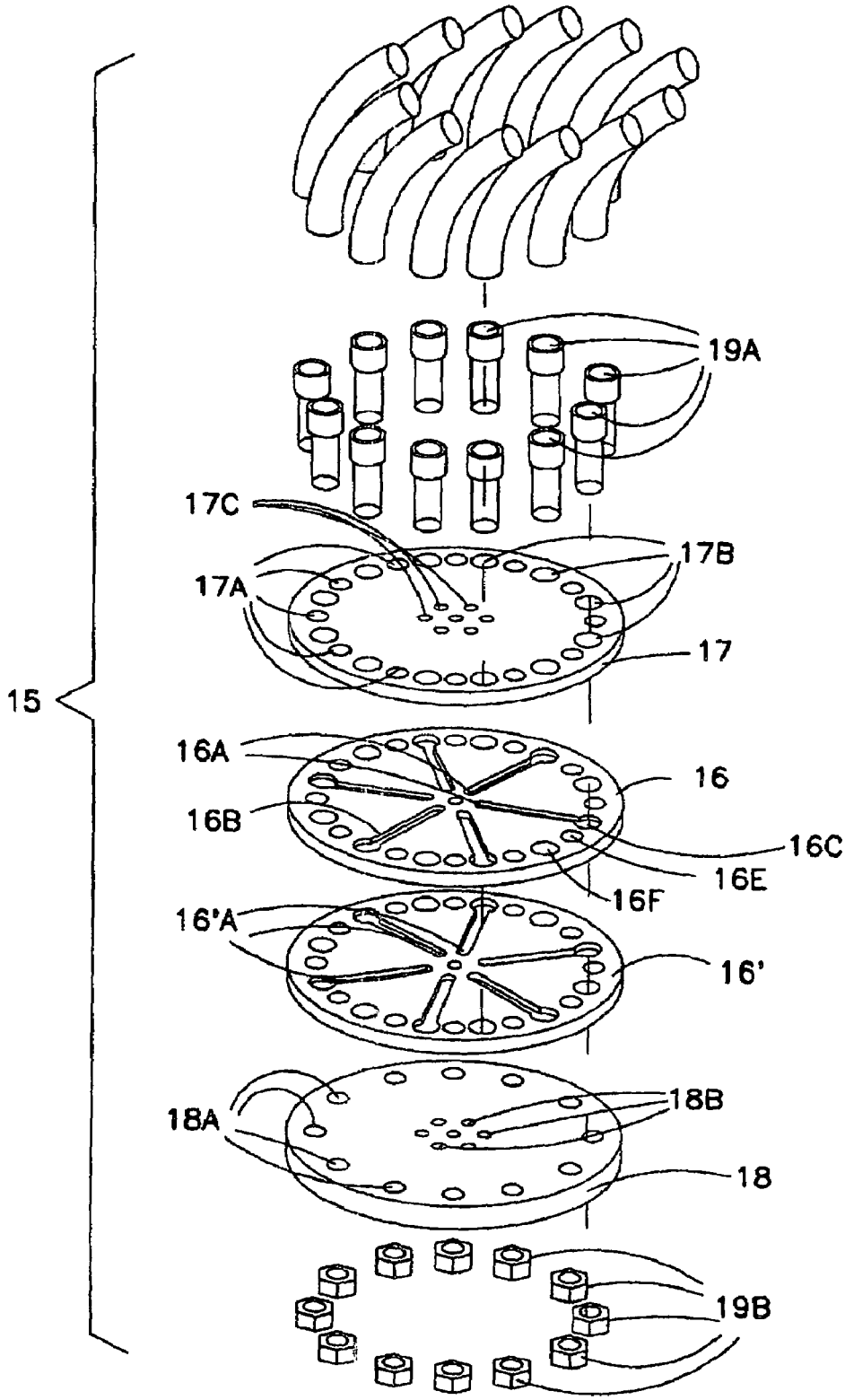
FIG. 5 is an exploded perspective view of the fluid-jet twisting apparatus in the rotary fluid-jet assembly of FIG. 4.
Figure 6:
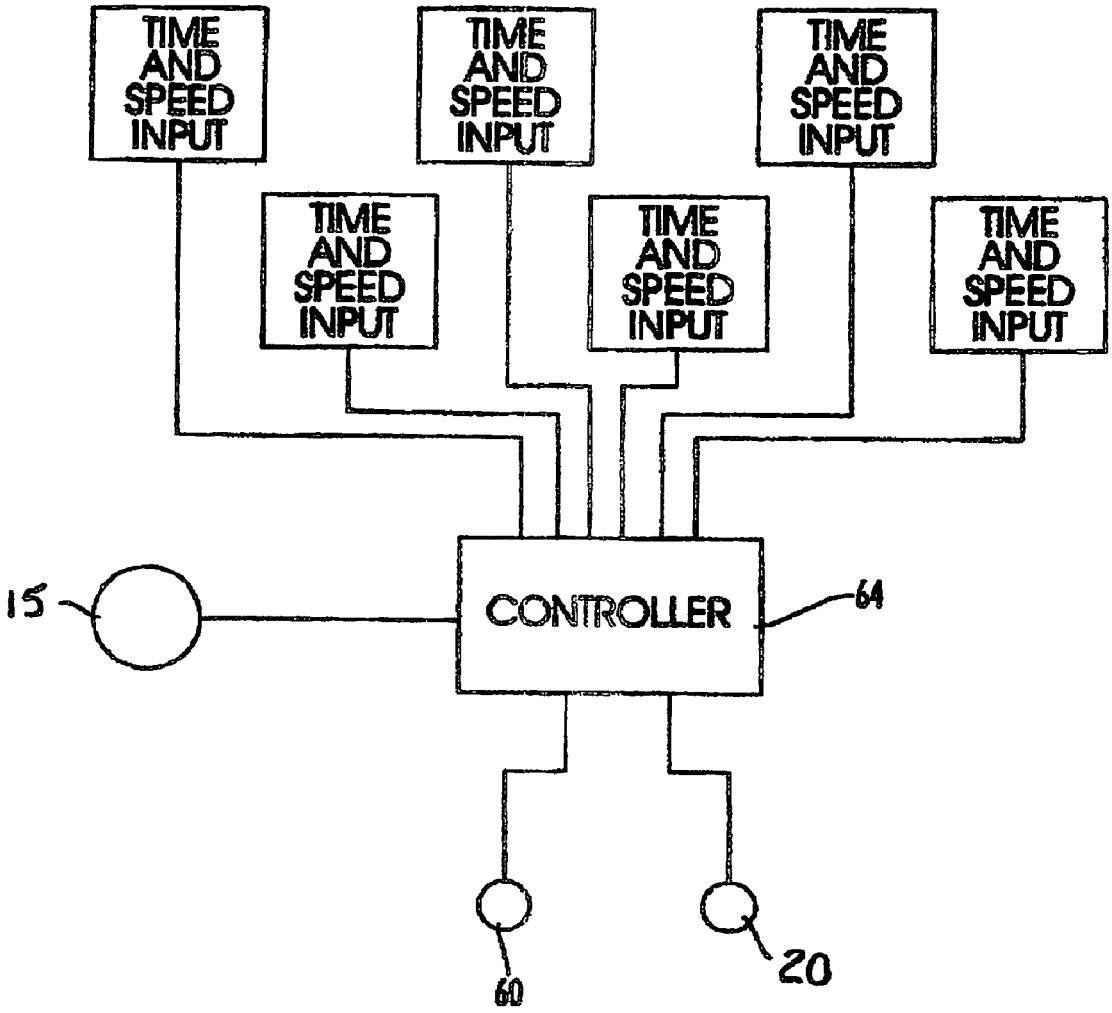
FIG. 6 is an electrical flow diagram for the control of the motors and fluid-jet assembly for the yarn twisting apparatus according to various embodiments.

According to various embodiments, and as shown in the exemplary embodiment of FIG. 4 and FIG. 5, the twist inserting apparatus 15 can be formed from two disks 16 and 16'. An identical pattern of channels, nozzles and orifices can be cut into both disks to permit the disks to be placed in overlying relation to each other and sandwiched between top end block 17 and bottom end block 18 so that either disk can be used to insert S-twist and Z-twist by inverting one disk 16, 16' against the other disk 16, 16'. The top block 17 can operate as an air feed manifold and distribute air from the remote source 70 of pressurized air to the twist inserting apparatus 15 under the control of programmed solenoid valve/s 80, pressure transducer/s 50 and programmable controller 64. The top block 17 and bottom block 18 can be held together using machine screws 19A, which extend through holes in the disks 16, 16' and block holes 17A, 18A, and are captured by nuts 19B. As described in more detail in U.S. Pat. No. 6,345,491, which is incorporated herein in its entirety by reference, yarn orifices 17C and 18B can be formed in respective blocks 17 and 18, and yarn orifices 16A, 16'A can be formed in the disks 16, 16'. Yarn orifices 16A can be radially spaced along air channels 16B from air supply orifices 16C, with the channels 16B communicating with yarn orifices 16A such that air entering the yarn orifices 16A from the channels 16B creates a cyclonic air circulation pattern. This air movement contains sufficient energy to cause the yarn moving through yarn orifices 16A to be twisted about its own axis. The amount of twist inserted into the yarn or the twist level, can be varied by controlling the pressure of the air supplied to the air channels 16B from air supply orifices 16C.

Figure 3:
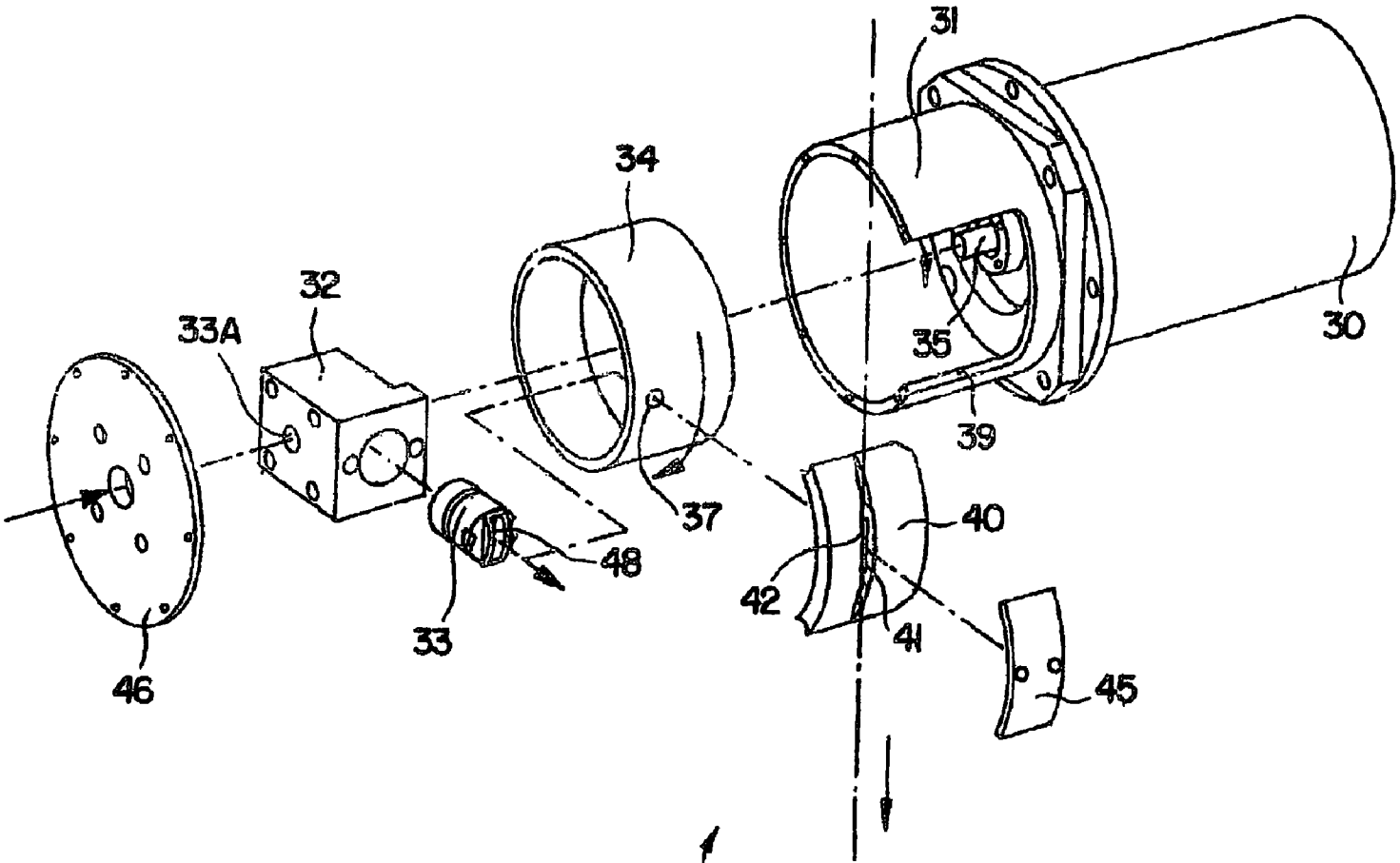
FIG. 3 is an exploded view of a rotary fluid-jet assembly according to an embodiment.

According to various embodiments, and as shown in FIG. 2, FIG. 3, and FIG. 4, the yarn having twist imposed by twist inserting apparatus 15 can then be passed through the rotary air jet assembly 20. The rotary air jet assembly 20 is provided with a drive motor 30 and a protective shroud 31 that is positioned on one side of the motor 30 and encloses several components of the rotary air jet assembly 20. A manifold housing 32 can be mounted in the shroud 31, as shown in FIG. 3, and carries an air manifold 33 which supplies pressurized air to the rotary air jet assembly 20. A rotating, cylindrical air jet can be carried for rotation on the motor shaft 35 of the drive motor 30. Rotating nozzle 34 is provided with an air jet orifice 37 through which air may pass at predetermined intervals. A yarn twister plate 40 is provided within a cutaway section 39 defined by the walls of shroud 31. The plied yarns 11 exiting twist inserting apparatus 15 pass through a vertically oriented yarn slot 41 defined within yarn guide plate 40. An orifice 42 in the yarn slot 41 communicates with the air jet nozzle 34. The yarn guide plate 40 fits over the cutaway section 39 to guide the plied yarn 11 pass the air jet nozzle 34. A cover 45 positioned over the yarn slot 41 of the yarn guide plate 40 prevents uncontrolled escape of air from the proximity of the yarn 11, thereby producing in cooperation with the yarn guide plate 40 the air turbulence which entangles the yarn 11.

In addition to controlling the rate at which motor 60 rotates the take-up rolls 22, 23, the controller 64 can also control drive motor 30 on the rotary air jet assembly 20 as well as the injection of air through twist inserting apparatus 15. Air provided through the air jet orifice 37 in rotary air jet assembly 20 can be used to supplement the twist that has already been provided to the yarn by twist inserting apparatus 15, or can be used to entangle the yarn 11 after the twisted strands have been brought together to "self-twist" into a plied yarn, with the entangling of the plied yarn being performed in sections that separate sections of the yarn having twist in different directions. Although only one air jet orifice 37 is shown on the air jet nozzle 34 in FIG. 3, more than one orifice 37 could also be provided such that additional twist reversal points or areas of entangled fibers could be provided at varying distances from each other along the yarn passing through the rotary air jet assembly 20.

Referring to FIGS. 2 and 3, air is ejected from manifold 33 through outlet port 48. The forward walls of the manifold 33 defining the air outlet port 48 are arcuately shaped to seal against the inside wall of rotating air-jet nozzle 34. As air-jet nozzle 34 rotates, the air-jet orifice 37 moves past the air outlet port 48. Each complete rotation thus creates a pulse of pressurized air which passes through the air outlet port 48, the air-jet orifice 37, the yarn slot orifice 42 and into the yarn slot 41 in the yarn guide plate 40. If the yarn 11 is traveling with the same velocity as the air-jet orifice 34, the air-jet nozzle will act on a given spot on the yarn for each passage of the air-jet orifice 37 past the yarn slot 41. By increasing or decreasing the velocity of the air-jet nozzle 34 relative to the velocity of the yarn 11 through the yarn slot 41, and past the yarn slot orifice 42, the length of yarn acted on by air flowing from the air-jet nozzle 34 can be controlled with a very high degree of precision. This air flow can be used to produce a desired length section of yarn with a twist reversal, or alternatively, can be used to enhance twist already incorporated into the yarn by the twist inserting apparatus 15. The position of the air-jet orifice 37 can also be varied with respect to the yarn slot orifice 42, such that it is laterally centered, or shifted off-center relative to the axis of the yarn.

The twist level of the yarn, the length segments of the yarn having particular twist levels, the direction of twist and the spacing of twist reversal segments generated by the rotary air jet assembly 20 all affect the final characteristics of the finished twisted yarn that is wound onto the product package roll 12 as shown, for instance, in FIG. 1. Depending on the desired characteristics of the finished yarn, the programmable controller 64 can be programmed to produce a desired pattern by providing information to the controller 64 such as the desired rotating speed for motors 60 and 30, as well as controlling the supply of air to the rotary air jet assembly 20 and to the twist inserting apparatus 15.

As illustrated in FIG. 4, and in accordance with various embodiments, if it is desired to produce a finished yarn having a pattern with six different twist segments, the controller 64 can receive programmed input of the speeds at which each of the motors must run for a given period of time as well as the pressure and/or flow rate of air that must be provided to the twist inserting apparatus 15 and the rotary air jet assembly 20 for given periods of time for each segment of the pattern. This information can then be directed by the controller 64 to respective output channels of the controller, which then provide control signals to the drive motor 60, the drive motor 30 of rotary air jet assembly 20, pressure transducer 50 and solenoid valves 80, or other air control devices for twist inserting apparatus 15 and the rotary air jet assembly 20. The controller 64 therefore uses this programmed information in accordance with desired patterns of twist to be provided to the yarn in producing a finished twisted yarn that is wound upon the package roll 12 or otherwise collected or processed.

Where the motors 60, 30 (see FIGS. 1 and 4) are servo motors, the controller 64 may be a conventional microprocessor-based programmable industrial controller such as those marketed by Giddings & Lewis of Fond du Lac, Wis., U.S.A. under the trademark PiC900. This controller provides motion control of servo motors and drives in a simple manner such that it is readily usable with the twisting system according to various embodiments. A RAM (random access memory) disk stores data for the pattern selection. At each instant of the pattern the controller instructs each servo motor drive to drive the servo motor at a selected speed in accordance with the twist level called for by the pattern, as well as instructing the air control devices to provide the desired flow rate and direction of air flow to achieve the desired twist characteristics. Thus, the air supply to twist inserting apparatus 15 and air jet assembly 20, the speed of the air jet orifice 32, the speed of the take-up rolls 22, 23, and the time periods during which desired air pressures, flow rates of air and/or speeds of the one or more rotating air jet orifices and/or speeds of the take-up rolls are applied, can all be controlled in accordance with the desired pattern.

The pattern may, for example, begin with 33 inches of 0.25 turn per inch of twist, 37 inches of 1 turn per inch of twist, 41 inches of 1.5 turns per inch of twist, 29 inches of two turns per inch of twist, five inches of 0.5 turn per inch of twist, etc. Carpet and/or other textile substrates can be produced using the twisted yarn with varying twist levels to achieve a desired aesthetic result.

The present invention, in addition, relates to variable twisted yarn. The yarn can be twisted using air twisting methods, such as discussed above, and/or cabling type twisting methods, two-for-one twisting methods, or ring twisting methods, such as explained in detail in U.S. Pat. No. 5,706,642, which is incorporated in its entirety herein by reference. The variable air twisted yarn can be made by the process described above. The yarn that is used and twisted can be any type of yarn. For instance, the yarn can be natural or synthetic yarn. Examples include solution dyed yarn, polyester, polyamide, polyolefin fibers, and co- or ter-polymers thereof. The variable twisted yarn can have one or more, and preferably two or more, different twist levels present in the length of yarn. In other words, the yarn can have one portion of the yarn with a first number of twists per inch and another portion of the yarn can have a second number of twists per inch, wherein the first number of twists per inch is different from the second number of twists per inch. The number of twists can be any number as described above, such as from 0.25 to 3 twists per inch or more. According to various embodiments, a slight amount of twist and/or variation in twist, such as from approximately 0.25 twist per inch to approximately 1.5 twists per inch, or from approximately 0.25 twist per inch to approximately 3.0 twists per inch, is effective to give the finished carpet made from the twisted yarn a uniform appearance in spite of possible variations in characteristics of the yarn, such as color. This may occur for yarn drawn from different supply spindles.

The present invention further relates to textile substrates, such as various types of carpet, which contain at least a portion of the variable twisted yarn. The carpet can be rolled carpet or carpet tiles of any size. For instance, the rolled carpet can be 6 ft to 12 ft rolled carpet. The remaining components of the carpet and the manner of making the carpet are conventional except for the use of the variable twisted yarn with slight twist in the range from approximately 0.25 twist per inch of yarn to 1.5 twists per inch of yarn, or from approximately 0.25 twist per inch to approximately 3.0 twist per inch, with the slight twist being effective to give the finished carpet a uniform appearance in spite of possible variations in characteristics of the yarn supplied from different spindles. The carpet can be piled or looped. For instance, the variable twisted yarn can be tufted into a primary backing and then a pre-coat layer can be applied to lock the tufts in. A reinforcing layer can be adjoined to a bottom surface of the pre-coat layer or elsewhere. Any number of intermediate layers and a secondary backing can be used, which are conventional in the industry. For instance, the layers and materials and processes described in U.S. Pat. No. 6,510,872; 6,479,125; 6,468,623; 6,435,220; 6,217,974; 6,203,881, 6,051,300; 5,962,101; 5,800,898; 6,497,936; 6,316,075; and, 5,540,968 in their entirety by reference herein.

Numerous alterations of the structure herein disclosed will suggest themselves to those skilled in the art. However, it is to be understood that the present disclosure relates to various embodiments, and is for purposes of illustration only and not to be construed as a limitation of the various embodiments. All such modifications which do not depart from the spirit of the various embodiments are intended to be included within the scope of the appended claims.

What is claimed:

1. A textile substrate comprising:

at least a portion having variable twisted yarn, wherein the variable twisted yarn includes two or more strands of yarn having a twist level variation, the twist level variation ranging from approximately 0.25 to approximately 1.5 turns per inch of the yarn, wherein said twist level is effective to provide to said textile substrate a uniform and consistent appearance that is visually the same in that said twist level minimizes an appearance of streaking in the textile substrate.

2. The textile substrate of claim 1, wherein at least two of the strands of yarn are taken from different supply spindles.

3. The textile substrate of claim 1, wherein the variable twisted yarn extends upwardly from a top surface of a backing and forms a loop pile surface.

4. The textile substrate of claim 1, wherein the textile substrate is a carpet tile.

5. The textile substrate of claim 1, wherein the textile substrate is a rolled carpet.

6. The textile substrate of claim 1, wherein the variable twisted yarn extends upwardly from a top surface of a primary backing and forms a loop pile surface, a pre-coat layer adjoining a bottom surface of the primary backing, and a reinforcing layer adjoining a bottom surface of the pre-coat layer.

7. The textile substrate of claim 6, wherein at least two of the strands of yarn are taken from different supply spindles such that each of the at least two strands has at least one characteristic that differs slightly from the same characteristic of the other one or more of the at least two strands, and the variation in twist of the at least two strands of yam is effective to give a uniform appearance with no streaking to a carpet made from the textile substrate.

8. The textile substrate of claim 1, wherein one of said strands of yarn has at least a portion that varies in color due to a different yarn lot.

9. A method for making a textile substrate of claim 1, comprising:

drawing a first strand of yarn from a first spindle of yarn;

drawing a second strand of yarn from a second spindle; and twisting at least the first and second strands of yarn together with an amount of twist or turns per inch of the yarn that varies between approximately 0.25 turn per inch to approximately 1.5 turns per inch.

10. The method of claim 9, further comprising:

tufting the twisted yarn into a primary backing, applying one or more intermediate layers to the primary backing, applying a secondary backing to the combination of primary backing and one or more intermediate layers.

11. A textile substrate comprising at least a portion having variable twisted yarn, wherein the variable twisted yarn includes two or more strands of yarn having a twist level variation, the twist level variation ranging from approximately 0.25 to approximately 1.5 turns per inch of the yarn, wherein said twist level is effective to provide to said textile substrate a uniform and consistent appearance that is visually the same, in spite of variations in appearance that are present in the yarn.

12. The textile substrate of claim 11, wherein at least two of the strands of yarn are taken from different supply spindles.

13. The textile substrate of claim 11, wherein the variable twisted yarn extends upwardly from atop surface of a backing and forms a loop pile surface.

14. The textile substrate of claim 11, wherein the textile substrate is a carpet tile.

15. The textile substrate of claim 11, wherein the textile substrate is a rolled carpet.

16. The textile substrate of claim 11, wherein the variable twisted yarn extends upwardly from a top surface of a primary backing and forms a loop pile surface, a pre-coat layer adjoining a bottom surface of the primary backing, and a reinforcing layer adjoining a bottom surface of the pre-coat layer.

17. The textile substrate of claim 16, wherein at least two of the strands of yarn are taken from different supply spindles such that each of the at least two strands has at least one characteristic that differs slightly from the same characteristic of the other one or more of the at least two strands, and the variation in twist of the at least two strands of yarn is effective to give a uniform appearance with no streaking to a carpet made from the textile substrate.

* * * * *